United States Patent [19]

Kroll et al.

[11] Patent Number: 4,476,664

[45] Date of Patent: Oct. 16, 1984

[54] APPARATUS FOR INTRODUCING STACKS OF PAPER SHEETS OR THE LIKE INTO CARTONS OR ANALOGOUS RECEPTACLES

[75] Inventors: Gerald Kroll; Horst Vogel; Jürgen Peter, all of Hamburg, Fed. Rep. of Germany

[73] Assignee: E.C.H. Will (GmbH & Co.), Hamburg, Fed. Rep. of Germany

[21] Appl. No.: 322,563

[22] Filed: Nov. 18, 1981

[30] Foreign Application Priority Data

Nov. 20, 1980 [DE] Fed. Rep. of Germany ..... 3043724

[51] Int. Cl.[3] ..... B65B 39/12; B65B 5/06

[52] U.S. Cl. ..... 53/258; 53/259; 53/260

[58] Field of Search ..... 53/260, 258, 259, 255, 53/247, 251, 252

[56] References Cited

U.S. PATENT DOCUMENTS

| | | | |
|---|---|---|---|
| 764,500 | 7/1904 | Rice | 53/260 |
| 4,018,031 | 4/1977 | Smaw | 53/258 X |
| 4,047,362 | 9/1977 | Lister et al. | 53/258 X |
| 4,261,159 | 4/1981 | Aiuola et al. | 53/258 X |

*Primary Examiner*—Horace M. Culver

*Attorney, Agent, or Firm*—Peter K. Kontler

[57] ABSTRACT

Apparatus for filling cartons having three upstanding side walls and a horizontal side wall with stacks of paper sheets has a horizontal conveyor reciprocable into and from a carton while the carton is held at a filling station, a system for delivering stacks to that portion of the conveyor which enters a carton at the filling station, and a locating device installed at a level above the path of movement of stacks with the conveyor portion and having an indexible horizontal shaft for two fingers which are disposed opposite each other, and an indexing mechanism for the shaft. The shaft is indexed to a first position in which one finger extends into the path of movement of an oncoming stack during delivery of the stack onto the conveyor, thereupon throuh 90° to ensure that the fingers cannot interfere with introduction of the stack into the carton, and again through 90° when the stack enters the carton to thus ensure that the stack is stripped off the conveyor by the other finger while the conveyor is being withdrawn from the station. That finger which strips a stack off the conveyor thereupon retains its position until engaged by the next stack so that the next stack is properly oriented prior to introduction into the next empty carton at the filling station.

17 Claims, 6 Drawing Figures

APPARATUS FOR INTRODUCING STACKS OF PAPER SHEETS OR THE LIKE INTO CARTONS OR ANALOGOUS RECEPTACLES

CROSS-REFERENCE TO RELATED CASES

The apparatus of the present invention can be utilized in systems of the type disclosed in commonly owned copending U.S. application Ser. Nos. 192,442 and 192,444 filed Sept. 30, 1980 by Yilmaz and Peters et al., respectively now abandoned.

BACKGROUND OF THE INVENTION

The present invention relates to apparatus for manipulating stacks of overlapping sheets consisting of paper, cardboard, metallic foil, plastic foil or a combination of these. More particularly, the invention relates to improvements in apparatus for introducing or inserting stacks of sheets into receptacles, for example, into prefabricated cartons consisting of cardboard, wood, sheet metal or other suitable material. Still more particularly, the invention relates to improvements in apparatus wherein the means for inserting piles or stacks into receptacles includes a conveyor at least a portion of which is movable into the interior of an empty receptacle while it supports a stack of paper sheets or the like.

Heretofore known apparatus of the above outlined character normally serve for introduction of stacks of paper sheets or the like into receptacles of the type wherein three side walls extend upwardly from the bottom wall or panel and the fourth side wall is held in a horizontal or in a downwardly inclined position so as to provide a lateral opening for introduction of a stack into the interior of such receptacle. Reference may be had to the aforementioned commonly owned copending applications of Yilmaz and Peters et al. Once a stack is inserted into the receptacle, the conveyor is withdrawn from the space between the bottom sheet of the stack and the bottom wall of the receptacle, the fourth side wall is pivoted to its upright position, and the top of the thus filled and completely assembled receptacle is provided with a prefabricated cover or lid. Each stack can constitute a discrete or single stack (e.g., a ream) of paper sheets or a group of two or more stacks each of which may but need not be provided with an envelope.

A drawback of heretofore known apparatus of the just outlined character is that the speed at which the stacks are transported and/or otherwise manipulated prior to and during introduction into receptacles cannot be increased at will because the sheets or layers of a stack are likely to be shifted relative to each other as soon as the speed is increased above a certain value and/or in response to abrupt stoppage or acceleration of the stack. Furthermore, heretofore known devices for ensuring proper registry of sheets in a stack and/or proper orientation of stacks relative to the transporting means therefor are rather bulky, complex expensive and prone to malfunction. Moreover, the stacks which are already inserted into the corresponding receptacles, such as the aforediscussed cardboard cartons or the like, are likely to follow at least some movements of the conveyor during extraction or retraction of the conveyor from a freshly filled receptacle with attendant minor or pronounced misorientation of the stack so that the fourth side wall of the receptacle cannot be moved to its upright position and/or the receptacle cannot be provided with a cover or lid.

OBJECTS AND SUMMARY OF THE INVENTION

An object of the invention is to provide a novel and improved apparatus for inserting stacks of paper sheets or the like into prefabricated receptacles in such a way that the stacks and/or their constituents are not likely to be shifted during transport toward and/or subsequent to insertion into receptacles.

Another object of the invention is to provide the apparatus with novel and improved means for properly locating the constituents of as well as entire stacks during transport toward, during insertion and also subsequent to insertion into cardboard cartons or other types of receptacles.

A further object of the invention is to provide simple, compact, reliable and inexpensive locating means which can be installed in certain types of existing stack inserting apparatus to enhance the reliability of such apparatus, to increase the output and/or to replace the heretofore utilized locating means, if any.

An additional object of the invention is to provide a locating device which not only performs the aforediscussed important and desirable functions but is also capable of preventing extraction of the constituents of or entire stacks during withdrawal of the conveyor from the interior of a freshly filled receptacle.

An ancillary object of the invention is to provide novel and improved means for ensuring proper retention of certain component parts of the locating means in requisite positions during selected stages of operation of the inserting apparatus.

A further object of the invention is to provide an apparatus whose output exceeds or can appreciably exceed the output of heretofore known stack inserting apparatus and which can be used with equal advantage for manipulation of small, medium-sized or large simple or composite stacks including small, medium-sized or large sheets.

The invention is embodied in an apparatus for introducing stacks of paper sheets into cartons or analogous receptacles at a filling station. The apparatus comprises conveyor means (e.g., a reciprocable platform) movable along a predetermined path into and from the interior of an empty receptacle at the filling station, one or more conveyors or analogous means for delivering stacks to the conveyor means so that a stack on the conveyor means enters the receptacle at the filling station when the conveyor means thereupon completes its movement into the receptacle at the filling station, and means for locating the stacks on the conveyor means. The locating means includes an indexible carrier (preferably a horizontal shaft) which is adjacent to the path of movement of stacks with and relative to the conveyor means, at least two fingers, prongs or analogous stack-engaging elements mounted on the carrier at an angle of substantially 180° relative to each other and movable into and from the path of movement of stacks with the conveyor means in response to indexing of the carrier, and means for indexing the carrier, preferably stepwise and through angles of 90 degrees.

The apparatus further comprises means for moving the conveyor means along the predetermined path between a first position in which at least a portion of the conveyor means is withdrawn from a receptacle at the filling station and a second position in which such portion of the conveyor means is located in the interior of the receptacle at the filling station so that a stack which is placed onto such portion of the conveyor means in the first position of the conveyor means is introduced into the receptacle at the filling station in response to movement of the conveyor means to its second position.

The carrier is preferably adjacent to and is installed at a level above an inlet portion of the filling station, namely, a portion of the station where the stacks move with the aforementioned portion of the conveyor means while the conveyor means is advanced from its first toward its second position.

It is often preferred to provide the locating means with several pairs of stack-engaging elements which are spaced apart from each other, as considered in the axial direction of the carrier. One element of each pair of stack-engaging elements is at least substantially coplanar with one element of each other pair of such elements. This ensures that two or more aligned elements can engage and properly orient the front end face of an oncoming stack. The carrier is preferably indexible in such direction that one of its elements or one element of each pair of elements has a component of movement in the direction of advancement of stacks with the conveyor means while the conveyor means moves from its first to its second position, i.e., in a direction to introduce a freshly delivered stack into the interior of a receptacle at the filling station.

The indexing means can comprise a freewheel or an analogous one-way clutch of any known design which is mounted on the carrier and comprises a ring, a race or an analogous rotary portion serving to rotate the carrier in response to rotation of such freewheel portion in a preselected direction, and means for rotating the freewheel portion at least in such preselected direction. The means for rotating the freewheel portion can comprise a double-acting fluid-operated motor (e.g., a pneumatic cylinder-and-piston unit). The cylinder or the piston rod of such unit is reciprocable and is articulately connected with the rotary freewheel portion.

The just discussed indexing means or an analogous indexing mechanism rotates the carrier through angles of preselected magnitude (as stated above, the carrier is preferably indexed in a single direction and through angles of 90°), and the apparatus preferably further comprises detent means for releasably holding the carrier in each angular position. The detent means can comprise a disc or an analogous female detent member which is affixed to and coaxial with the carrier and has a peripheral surface provided with a plurality of equidistant notches, flutes or analogous recesses, one for each angular position of the carrier, and a male detent member (e.g., a pivotable lever) having a portion (such as a roller follower) movable into and from successive recesses of the female detent member. The detent means can further comprise motor means (such as a pneumatically operated cylinder-and-piston unit) for moving the lever between first and second positions in which the follower respectively extends into and is withdrawn from a recess of the female detent member.

The conveyor means has a preferably flat stack-supporting surface which is preferably located in a substantially horizontal plane, and one of the two elements on the carrier extends into the path of movement of an oncoming stack during delivery of such stack onto the surface of the conveyor means prior to indexing of the carrier in a direction to withdraw the one element from the path of movement of the stack on the conveyor means and before the conveyor means begins to move into the receptacle at the filling station. The other element of the locating means extends behind the stack in the receptacle at the filling station upon completion of transfer of the stack into the receptacle so that such other element prevents the stack from leaving the receptacle during extraction of the conveyor means from the receptacle at the filling station. The elements are preferably movable to positions substantially at right angles to and to positions of substantial parallelism with the surface of the conveyor means. The indexing means and/or the aforementioned detent means holds the carrier against indexing during intervals which elapse between the removal of a filled receptacle from the filling station and the delivery of a fresh receptacle to such station. This means that the other element can constitute the one element in connnection with the treatment (reorientation, if necessary, and stoppage) of the next following stack which is transferred onto the supporting surface of the conveyor means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 3A:
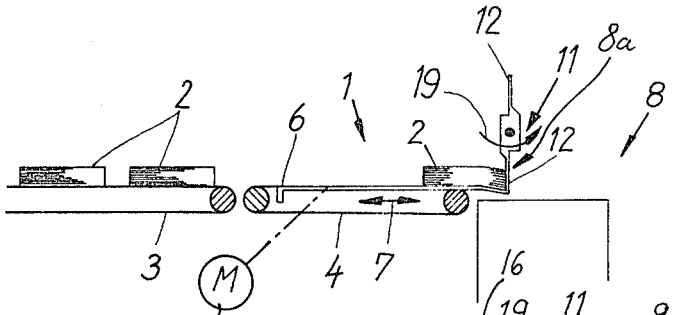
FIG. 3*a* is a smaller-scale schematic elevational view of the improved apparatus, with the conveyor which introduces stacks into receptacles at the filling station shown in its first position and with a stack on the conveyor abutting against one set of prongs of the locating means.
Figure 3B:
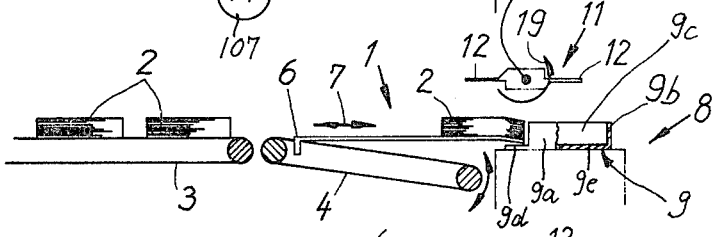
FIG. 3*b* illustrates the structure of FIG. 3*a*, with the prongs of the locating means in their inoperative positions and with the front portion of the stack delivering means moved out of the way to allow for introduction of a stack into an empty receptacle at the filling station.
Figure 3C:
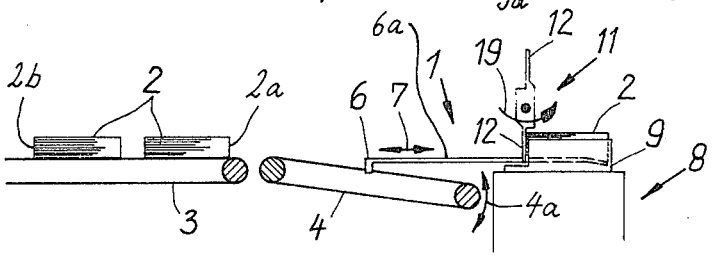
FIG. 3*c* illustrates the structure of FIG. 3*b*, with the shaft of the locating means indexed through 90° subsequent to introduction of a stack into the receptacle at the filling station.
Figure 3D:
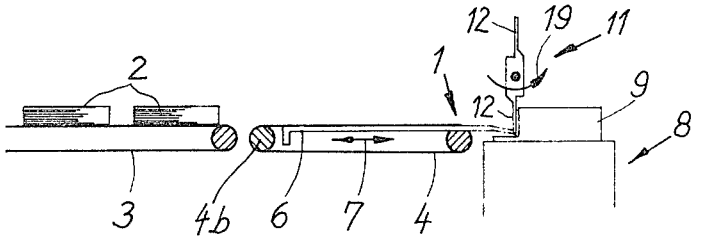
FIG. 3*d* illustrates the structure of FIG. 3*c*, with the conveyor returned to its first position and with those prongs of the locating means which prevented the extraction of a freshly inserted stack from the receptacle in positions of readiness to intercept and orient the next-following stack.

The apparatus 1 which is shown in FIG. 3*a* comprises a filling station 8 for reception of a succession of discrete empty receptacles in the form of cartons 9 (shown in each of FIGS. 3*b*, 3*c* and 3*d*). The cartons 9 can be supplied by a conveyor of the type disclosed in the aforementioned commonly owned copending U.S. application Ser. No. 192,444 of Peters et al., i.e., at right angles to the plane of FIG. 3*a* and at spaced intervals. Each carton 9 which arrives at the station 8 has three upstanding side walls 9*a*, 9*b*, 9*c*, a substantially horizontal or downwardly sloping side wall 9d, and a substantially horizontal bottom wall or panel 9e. The conveyor which supplies empty cartons 9 to the filling station 8 comprises means for accurately positioning each empty carton for reception of a stack 2 of superimposed paper sheets or the like. The opening between the side walls 9a, 9c of a properly oriented and positioned empty carton 9 at the filling station 8 faces in a direction to the left, as viewed in FIG. 3b, 3c or 3d.

The apparatus 1 further comprises a conveyor 6 which is shown in the form of a substantially horizontal platform or grating consisting of several strip-shaped sections which are disposed in a common plane and are parallel to each other. The sections of the conveyor 6 define a stack-supporting surface 6a which faces upwardly and can adequately support a stack 2 which is fed thereto by a delivering means including a first belt conveyor 3 and a second belt conveyor 4. The source of supply of stacks 2 is not specifically shown in the drawing; such stacks can be formed in a machine which subdivides large sheets of paper or the like into smaller sheets by cutting the large sheets lengthwise and crosswise. The horizontal upper reach of the conveyor 3 carries a series of two or more discrete stacks 2 and delivers the foremost stack 2 to the rear portion of the upper reach of the second belt conveyor 4 which consists of several endless parallel bands or strips located in planes parallel to the plane of FIGS. 3a to 3d. The upper reaches of individual strips or bands of the conveyor 4 alternate with the sections of the conveyor 6, and the front portion (namely, the right-hand portion, as viewed in FIGS. 3a to 3d) of the conveyor 4 is movable up and down in directions indicated by a double-headed arrow 4a. The illustrated conveyor 4 is pivotable about the axis of its rear pulley or pulleys 4b so that the upper reaches of its strips can descend below the level of the surface 6a when the conveyor 4 completes the delivery of the foremost stack 2 onto the right-hand end portion of the conveyor 6, namely, onto that portion of the conveyor 6 which is reciprocable into and from the interior of a carton 9 at the filling station 8. A reversible electric motor 107 or an analogous means is provided to move the conveyor 6 between the first end position which is shown in FIG. 3a and in which the right-hand end portion of the conveyor 6 is located outside of a carton 9 at the filling station 8, and a second end position which is shown in FIG. 3c and in which the right-hand portion of the conveyor 6 extends into the interior of the carton 9 at the filling station. As mentioned above, the open side of a properly oriented carton 9 faces to the left, as viewed in FIGS. 3b, 3c and 3d, so that the stack-bearing right-hand end portion of the conveyor 6 can advance over the side wall 9d of such carton and onto the bottom panel or wall 9e. The directions in which the conveyor 6 is reciprocable between the first end position of FIGS. 3a, 3b, 3d and the second end position of FIG. 3c are indicated by a double-headed arrow 7. The upper reaches of the strips which form part of the conveyor 4 are coplanar with the sections of the conveyor 6 when such upper reaches deliver a stack 2 onto the surface 6a, and the upper reaches of such strips descend below the level of the conveyor 6 (see FIGS. 3b and 3c) not later than when the conveyor 6 begins to move from the first end position of FIG. 3b to the second end position of FIG. 3c in order to introduce a stack 2 into the interior of the carton 9 at the filling station 8.

Figure 1:
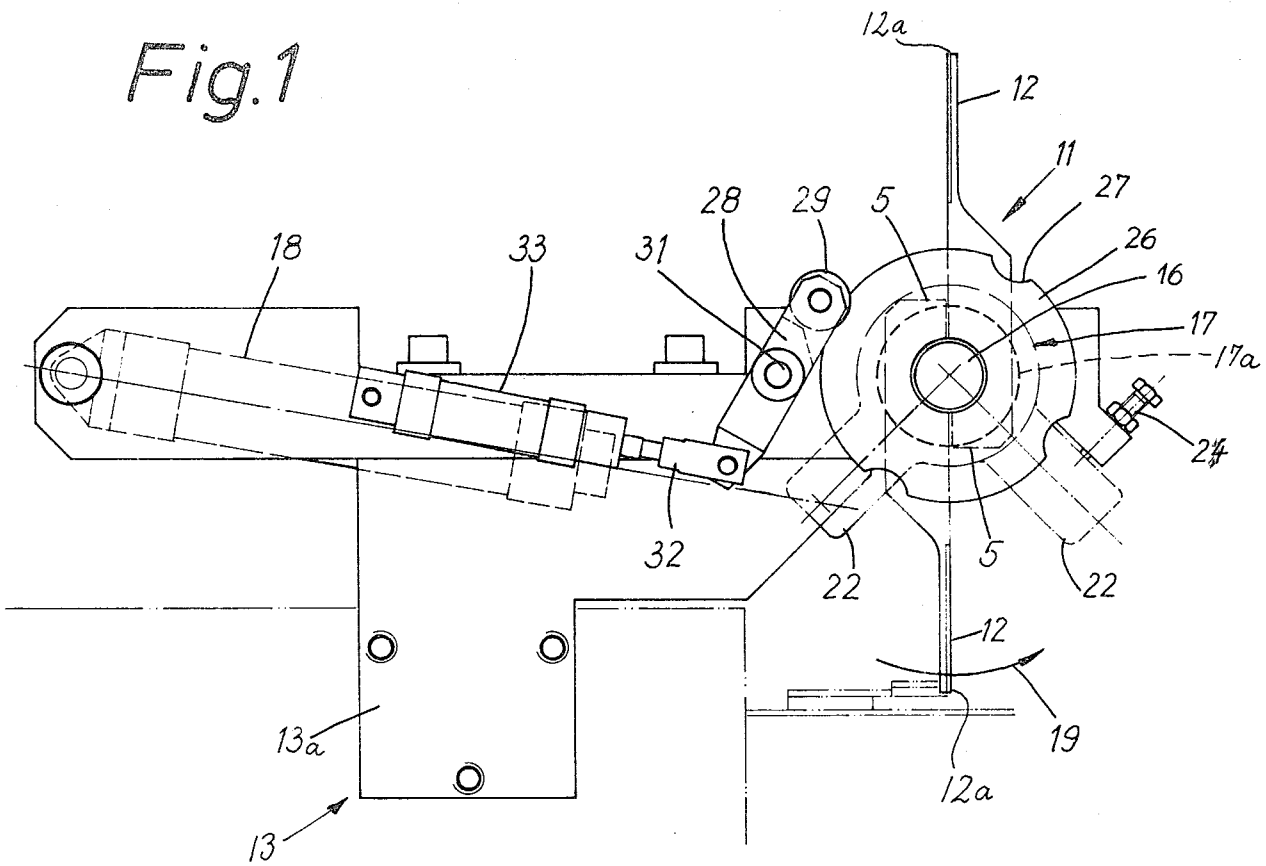
FIG. 1 is a side elevational view of the novel locating means which constitutes an element of the improved apparatus.
Figure 2:
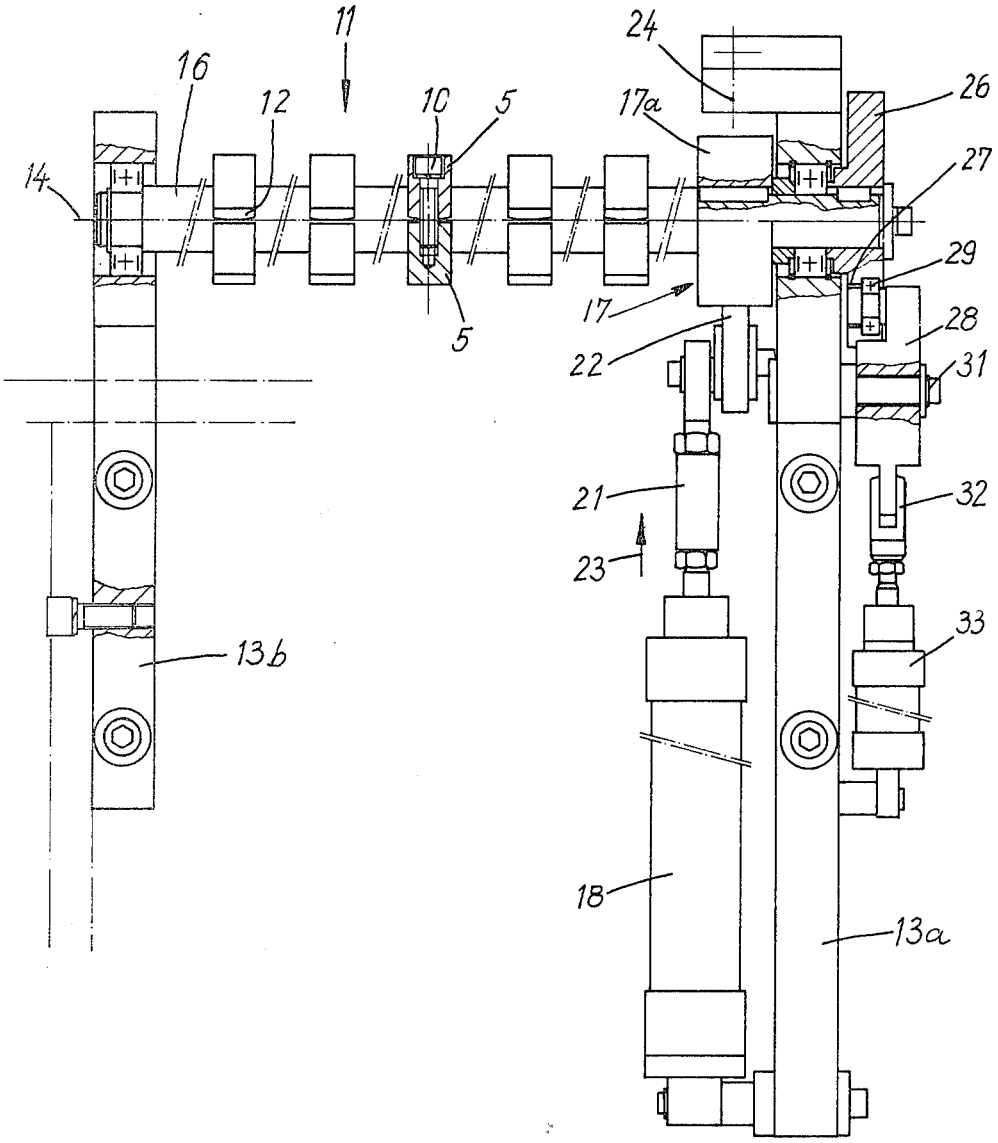
FIG. 2 is a plan view of the locating means with certain parts shown in section.

In accordance with a feature of the invention, the apparatus 1 further comprises a novel and improved locating device 11 which is installed at a level above the path of stacks 2 on the surface 6a of the conveyor 6 and is mounted in the frame 13 (see FIGS. 1 and 2) in the region of the inlet 8a to the station 8, namely, in the region where the front side or end face 2a of a freshly supplied stack 2 is located prior to entering an empty carton 9. The details of the locating device 11 are shown in FIGS. 1 and 2. This device comprises a horizontal or substantially horizontal carrier 16 (such as an elongated shaft or rod) for several pairs of stack-engaging elements in the form of fingers or prongs 12. As can be seen in FIG. 2, the shaft 16 carries more than two pairs of prongs 12, and such pairs are spaced apart from each other, as considered in the direction of the horizontal axis 14 which is the axis of the shaft 16. The end portions of the shaft 16 are rotatably journalled in the portions 13a and 13b of the frame, 13, and such frame portions are disposed at the opposite sides of the path of movement of the conveyor 6 between its first and second end positions. The level of the axis 14 of the shaft 16 can be selected in such a way that the tips 12a of the prongs 12 extend beyond the surface 6a when the lower prong 12 of each pair of prongs extends downwardly and the prongs are disposed in a plane which is normal to the plane of the surface 6a. The sections of the conveyor 6 alternate with the pairs of prongs 12, i.e., the conveyor 6 cannot interfere with indexing of the shaft 16 about the axis 14 irrespective of the position of this conveyor because the tips 12a can readily bypass the neighboring conveyor sections. The two prongs 12 of each pair are disposed diametrically opposite each other, i.e., they are angularly offset by 180°. The inner ends of the prongs 12 carry or are integral with shell-like portions 5 which can be secured to the shaft 16 by screws 10 or the like or which can be secured to each other by screws 10 or analogous fasteners. All that counts is to ensure that the prongs 12 are preferably adjustably but fixedly connected to the shaft 16 so that they can stand stresses which develop when one prong of each pair is to arrest an oncoming stack 2 by extending into the path of movement of the front end face 2a of such stack or when a prong of each pair is to ensure that a stack 2 which has been introduced into a carton 9 at the filling station 8 is stripped off the conveyor 6 while the conveyor moves back from the second end position shown in FIG. 3c to the first end position of FIG. 3d.

The means for indexing the shaft 16 and the pairs of prongs 12 in a preselected direction (as indicated by the arrow 19) so that the prongs which are nearer to the conveyor 6 have a component of movement in the direction of advancement of the conveyor 6 from its first end position (see, for example, FIG. 3b) to its second end position (see FIG. 3c) comprises a commercially available freewheel 17 which is mounted on the shaft 16. This freewheel may be of the type kown as AV 25 manufactured and sold by the firm Stieber, Federal Republic Germany. The means for indexing the shaft 16 further comprises a motor, preferably a fluid-operated motor, and most preferably a double-acting pneumatic cylinder and piston unit whose cylinder 18 is articulately connected with the frame 13 and whose piston rod 21 is articulately connected with a radial arm 22 secured to a rotary portion 17a of the freewheel 17. The arrangement is such that the freewheel 17 causes the shaft 16 to rotate in the direction of arrow 19 when the unit including the cylinder 18 moves the arm 22 from the solid-line to the phantom-line position of FIG. 1, and that the shaft 16 is at a standstill when the portion 17*a* of the freewheel 17 is rotated in the opposite direction. A preferably adjustable stop 24 is provided on the frame 13 to arrest the arm 22 in the phantom-line position of FIG. 1. The strokes of the piston rod 21 (which is movable in and counter to the directon indicated by arrow 23) are selected in such a way that the shaft 16 is indexible through angles of 90°, always in the direction of arrow 19.

The apparatus 1 also comprises detent means for releasably holding the shaft 16 in selected angular positions for desired intervals of time. The detent means comprises a female detent member 26 which is a disc affixed to the shaft 16 and having a peripheral surface formed with four equidistant recesses 27 in the form of notches or flutes. The detent means further comprises a male detent member in the form of a two armed lever 28 which is pivotally mounted on a horizontal shaft or stud 31 of the frame 13 and whose upper arm carries a roller follower 29 movable into and retractible from the adjacent recess 27. The means for pivoting the lever 28 in order to introduce the roller follower 29 into or to retract such follower from the adjacent recess 27 comprises a second motor including a double-acting pneumatic cylinder 33 whose piston rod 32 is articulately connected with the lower arm of the lever 28, as viewed in FIG. 1. That end portion of the cylinder 33 which is remote from the disc 26 is articulately connected to the frame 13. The detent means contributes to the ability of prongs 12 to withstand the forces which are exerted upon the prongs by an oncoming stack 2 as well as those forces which are applied by an inserted stack 2 while the preferably thin conveyor 6 moves back to its first end position so that its right-hand end portion (as viewed in FIGS. 3*a* to 3*d*) is withdrawn from the space between the lowermost sheet of a fully inserted stack 2 and the bottom panel or wall 9*e* of a freshly filled carton 9. The distance between neighboring recesses 27 of the disc 26 is 90°, i.e., the follower 29 is ready to enter the adjacent recess 27 whenever the motor including the cylinder 18 completes the indexing of the shaft 16 through 90°.

The operation of the apparatus 1 is as follows:

The stack delivering means including the conveyors 3 and 4 feeds successive stacks 2 onto the right-hand end portion of the conveyor 6 at desired intervals. When the surface 6*a* is to receive a fresh stack 2, the conveyor 6 is held in the first end position of FIG. 3*a* and one prong 12 of each pair of prongs on the shaft 16 extends vertically downwardly toward or even beyond the plane of the surface 6*a* so that the left-hand sides of such downwardly extending prongs 12 extend into the path of movement of the oncoming stack 2. The stack 2 is properly oriented as a result of engagement of its front end face 2*a* with the respective sides of the downwardly extending prongs 12. The prongs 12 cannot yield to the oncoming stack 2 because the roller follower 29 of the lever 28 then extends into the adjacent recess 27 of the disc 26 which is rigid with the shaft 16. Such angular position of the shaft 16 is shown in FIGS. 1 and 3*a*. The right-hand portion of the conveyor 4 is lifted (i.e., it assumes the position which is shown in FIG. 3*a*) while its strips deliver a stack 2 toward and against the downwardly extending prongs 12 of the locating device 11. The downwardly extending prongs 12 of the device 11 not only ensure that the orientation of the oncoming stack 2 does not change (if such orientation was proper during transport by the conveyors 3 and 4) but the downwardly extending prongs 12 can also change the orientation of the oncoming stack and/or of certain layers or sheets of such stack to thus ensure that the stack will be properly introduced into a carton 9 at the filling station 8 even if the dimensions of the carton only slightly exceed the dimensions of the respective stack 2.

In the next step, the conveyor 4 is pivoted about the axis of its rear pulley or pulleys 4*b* so that its upper reach descends below the level of the surface 6*a*, i.e., the stack 2 whose front end face 2*a* abuts against the downwardly extending prongs 12 of the locating device 11 is then supported exclusively by the conveyor 6 which is ready to start its movement from the first end position of FIG. 3*b* to the second end position of FIG. 3*c*. A freshly filled carton 9 is removed from and an empty carton 9 is delivered to the filling station 8 during the interval which is required to advance a stack 2 from the conveyor 3 or from the left-hand portion of the conveyor 4 onto the right-hand end portion of the conveyor 6. Before the motor 107 begins to move the conveyor 6 from the first end position of FIG. 3*b*, the motor including the cylinder 18 is actuated by moving the piston rod 21 in the direction of arrow 23 so that the arm 22 turns the rotary portion 17*a* in the direction of arrow 19 and the portion 17*a* causes the freewheel 17 to rotate the shaft 16 in the same direction until the arm 22 reaches and is arrested by the stop 24. This results in an angular displacement of all prongs 12 through 90° and, as mentioned above, the prongs 12 which were adjacent to the front end face 2*a* of the stack 2 on the right-hand end portion of the conveyor 6 turn in a counterclockwise direction, as viewed in FIG. 3*a*, so as to assume the positions which are shown in FIG. 3*b* and in which their plane (including the axis 14 of the shaft 16) is parallel to the surface 6*a* of the conveyor 6. The level of the axis 14 is selected in such a way that, when the shaft 16 is indexed to the angular position of FIG. 3*b*, the prongs 12 cannot interfere with advancement of a stack 2 into the interior of the carton 9 at the filling station 8. The just described angular movement of the shaft 16 through 90° involves a movement of the tips 12*a* of downwardly extending prongs 12 from a lower level at or even below the plane of the surface 6*a* to a higher level above the path of movement of stacks 2 with the conveyor 6 toward and into the cartons 9 at the filling station 8.

The motor 107 is thereupon started in a direction to shift the conveyor 6 from the first end position of FIG. 3*b* to the second end position of FIG. 3*c* and to thus effect introduction of the stack 2 on the surface 6*a* into the empty carton 9 at the filling station 8. The motor 107 can begin to move the conveyor 6 toward the position of FIG. 3*c* practically simultaneously with indexing of the shaft 16 from the angular position of FIG. 3*a* to the angular position of FIG. 3*b*; all that counts is to ensure that the prongs 12 do not interfere with orderly delivery of stacks 2 into the cartons 9.

The roller follower 29 may but need not enter the adjacent recess 27 while the shaft 16 dwells in the angular position of FIG. 3*b*; locking of the shaft 16 in such angular position is not absolutely necessary because the prongs 12 are not stressed while a stack 2 advances from the inlet 8*a* of the station 8 into the empty carton 9 at such station.

The motor including the cylinder 18 indexes the shaft 16 through 90° not later than when the conveyor 6 completes its movement to the second end position of FIG. 3*b*, i.e., when the stack 2 on the surface 6*a* is introduced into and confined in the corresponding carton 9. This moves the other prong 12 of each pair of prongs to a position adjacent to the rear end face 2*b* of the stack 2 in the carton 9, and the lever 28 is thereupon pivoted by the motor including the cylinder 33 so that the roller follower 29 enters the adjacent recess 27 and thereby holds the shaft 16 in the angular position of FIG. 3*c* during extraction of the right-hand end portion of the conveyor 6 from the interior of the freshly filled carton 9. The downwardly extending other prongs 12 then constitute a means for stripping the freshly inserted stack 2 off the surface 6*a*, i.e., for ensuring that the stack 2 remains in its carton 9 while the motor 107 retracts the conveyor 6 from the second end position of FIG. 3*c* to the first end position of FIG. 3*d*.

The freshly filled carton 9 is then removed from the filling station 8, its side wall 9*d* is pivoted upwardly into a vertical plane to close the opening between the side walls 9*a* and 9*c*, a cover is applied onto the filled carton, and the carton is then delivered to storage or to another destination. At the same time, the shaft 16 remains in the angular position of FIG. 3*c* so that the downwardly extending prongs 12 which constituted a stripping means can constitute a means for arresting and orienting the next-following stack 2 which is delivered onto the right-hand end portion of the conveyor 6 in retracted or first end position of such conveyor. It goes without saying that the right-hand portion of the conveyor 4 is or can be lifted as soon as the conveyor 6 completes its return stroke (or even before, i.e., as soon as the stack 2 on the surface 6*a* has been advanced beyond the right-hand portions of upper reaches of strips forming part of the conveyor 4).

It will be appreciated that, in order to ensure proper retention of a freshly inserted stack 2 in the respective carton 9, the path along which the cartons 9 are transported in a direction at right angles to the plane of FIG. 3*b*, 3*c* or 3*d* must be sufficiently close to the vertical plane of the prongs 12 so that one side of each downwardly extending prong 12 in the position shown in FIG. 3*c* can serve as a means for preventing extraction of a freshly inserted stack 2 and the other side of the same prong or prongs thereupon serves as a means for arresting and properly orienting the oncoming next-following stack. The thickness of the prongs 12 can be selected practically at will. The shaft 16 is indexed to move its prongs 12 into a substantially horizontal plane when the filling station 8 is empty (i.e., after a freshly filled carton 9 has been removed and prior to arrival of the next-following empty carton), and the shaft 16 is indexed to the position of FIG. 3*a*, 3*c* or 3*d* before the right-hand end portion of the conveyor 6 receives and supports a fresh stack 2. As used herein, the term "stack" is intended to denote a discrete pile of overlapping sheets as well as two or more suitably arrayed discrete piles which are transported simultaneously.

It is also within the purview of the invention to place the locating device 11 including the shaft 16 and its prongs 12 laterally of or at a level below the path of the conveyor 6. The embodiment which is shown in the drawing is preferred at this time because it is simple, compact and its component parts are readily accessible. Thus, by mounting the shaft 16 in such a way that it is indexible about a substantially horizontal axis 14 which is located at a level above the path of movement of the conveyor 6 and of the stack 2 on the surface 6*a*, one ensures that the locating device 11 can employ relatively short prongs 12 whose length need not exceed the distance between the shaft 16 and the plane of the surface 6*a*. Highly reliable orientation of oncoming stacks 2, and an equally reliable retention of all sheets of a freshly inserted stack in its receptacle, is ensured if the length of the prongs 12 (as considered in the radial direction of the shaft 16) is selected in such a way that the tips 12*a* of those prongs which extend downwardly (note FIGS. 3*a*, 3*c* and 3*d*) extend at least slightly beyond the level of the surface 6*a*. This presents no problems since the planes of the pairs of prongs 12 alternate with the planes of sections of the conveyor 6. Such arrangement reliably prevents collisions between the prongs 12 and the constituents of the conveyor 6; at the same time, such arrangement invariably ensures that the prongs 12 can orient and/or arrest and/or strip each and every sheet of a stack 2 during movement of the stack toward the inlet 8*a* of the filling station 8 or during extraction of the conveyor 6 from the freshly filled receptacle 9 at such station. The combined width of the two paddles of vanes which are formed by the two sets of prongs 12 can approximate or equal the width of the front of rear end face of a stack 2.

While the shaft 16 is indexed from the position of FIG. 3*b* to that which is shown in FIG. 3*c*, the set of prongs 12 which extend vertically downwardly after the indexing step is completed serves as a means for shifting (if necessary) those sheets or layers of the freshly inserted stack 2 which extend rearwardly and beyond the general plane of the rear end face 2*b* of the inserted stack. Such rearwardly extending sheets or layers cannot be shifted by the downwardly extending prongs 12 of FIG. 3*a* because these prongs can only shift the layers or sheets which extend forwardly and beyond the general plane of the front end face 2*a* of the stack 2 on the rightmost portion of the surface 6*a*.

The illustrated indexing means including the freewheel 17 and the means for rotating the portion 17*a* of this freewheel back and forth constitutes but one of the numerous devices which can be utilized to index the shaft 16 and its prongs 12 in stepwise fashion. By way of example, the shaft 16 could carry a pinion meshing with a reciprocable rack. A freewheel or another one-way clutch between the pinion and the shaft 16 would ensure that the shaft turns only when the pinion is rotated in the direction which is indicated by the arrow 19. It has been found that the illustrated indexing means is capable of ensuring that the shaft 16 is invariably turned through angles of preselected magnitude, i.e., through angles of 90 degrees if the shaft 16 carries pairs of coplanar prongs 12 and if the adjustable stop 24 is set to arrest the arm 22 as soon as the portion 17*a* of the freewheel 17 completes a quarter turn in a counterclockwise direction, as viewed in FIG. 1, 3*a*, 3*b*, 3*c* or 3*d*.

An important advantage of the improved apparatus is that it can process a large number of stacks per unit of time without risking misalignment of discrete sheets or layers of sheets in a stack during transport of the stack toward the filling station 8 and/or during extraction of the conveyor 6 from the freshly filled carton 9 at such station. The indexing of the shaft 16 can be readily synchronized with movements of the conveyors 3, 4, 6 as well as with movements of the conveyor for the cartons 9 in such a way that the prongs 12 cannot interfere with proper delivery of stacks 2 onto the surface 6*a*, with proper transfer of stacks into the respective cartons 9 and/or with extraction of the conveyor 6 from freshly filled cartons.

Another important advantage of the improved apparatus is that its locating device performs several desirable functions so that the provision of such locating device contributes to simplicity, compactness, reliability and lower cost of the apparatus. Thus, the prongs 12 can serve as a means for arresting an oncoming stack 2 with simultaneous alignment of certain sheets or layers of sheets preparatory to transfer of the stack from the region of the inlet 8*a* of the station 8 into the receptacle 9 at such station. The same prongs 12 can also serve as a means for preventing freshly inserted stacks 2 from leaving the respective receptacles 9, i.e., as a means for stripping the lowermost sheet of a freshly inserted stack off the surface 6*a* while the conveyor 6 moves from the second end position of FIG. 3*c* back to the first end position of FIG. 3*d*. Moreover, the prongs 12 can shift, if necessary, discrete sheets or one or more layers of sheets in a freshly inserted stack 2 during indexing of the shaft 16 from the angular position of FIG. 3*b* to the angular position of FIG. 3*c*. It will be noted that one side of each prong 12 is effective to arrest an oncoming stack 2 and to change the positions of sheets and/or layers of sheets which extend beyond the general plane of the front end face 2*a* of such stack, and that the other side of each prong serves to perform the aforementioned stripping action as well as the function of shifting certain sheets and/or layers of sheets which extend rearwardly and beyond the end face 2*b* of a freshly inserted stack 2. One side of each prong 12 acts upon the rear end face 2*b* of a freshly inserted stack 2, and the other side of such prong thereupon acts as a stop for the next-following stack 2 without the need to index the shaft 16. Such surprising versatility of the improved locating device greatly enhances the compactness of the apparatus without affecting the accuracy with which the stacks are arrested, their sheets or layers shifted (if necessary) and retained in the corresponding receptacles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for introducing stacks of paper sheets or the like into cartons or analogous receptacles at a filling station, comprising conveyor means having a stack-supporting surface and being movable along a predetermined path into and from the interior of a receptacle at said station; means for delivering stacks to said conveyor means so that a stack on said conveyor means enters the receptacle at said station when the conveyor means completes its movement into such receptacle; and means for locating stacks on said conveyor means, including an indexible carrier adjacent to said path, at least one pair of stack-engaging elements mounted on said carrier at an angle of substantially 180 degrees relative to each other and movable into and from the path of movement of stacks with and relative to said conveyor means in response to indexing of said carrier, and means for indexing said carrier, one of said elements extending into the path of movement of an oncoming stack during delivery of such stack onto said conveyor means prior to indexing of said carrier in a direction to withdraw such one element from the path of movement of the stack on said surface and before said conveyor means begins to move into the receptacle at said station, the other of said elements extending behind the stack in the receptacle at said station upon completion of introduction of the stack into the receptacle at said station so that said other element prevents the stack from leaving the receptacle during movement of said conveyor means from the receptacle at said station.

2. The apparatus of claim 1, further comprising means for moving said conveyor means along said path between a first position in which at least a portion of said conveyor means is withdrawn from a receptacle at said station and a second position in which said portion of said conveyor means is located in the interior of the receptacle at said station so that a stack which is placed onto said portion of said conveyor means in said first position of the latter is transferred into the receptacle at said station in response to movement of said conveyor means to said second position.

3. The apparatus of claim 1, wherein said carrier is a substantially horizontal shaft.

4. The apparatus of claim 3, wherein said station has an inlet portion along which a stack on said conveyor means moves into the receptacle at said station, said shaft being installed at said inlet portion and at a level above said path.

5. The apparatus of claim 1, wherein said carrier is indexible about a predetermined axis and said locating means comprises several pairs of stack-engaging elements, said pairs of such elements being spaced apart from each other as considered in the direction of said axis.

6. The apparatus of claim 5, wherein one element of any one of said pairs is at least substantially coplanar with an element of each other pair.

7. Apparatus for introducing stacks of paper sheets or the like into cartons or analogous receptacles at a filling station, comprising conveyor means movable along a predetermined path into and from the interior of a receptacle at said station; means for delivering stacks to said conveyor means so that a stack on said conveyor means enters the receptacle at said station when the conveyor means completes its movement into such receptacle; and means for locating stacks on said conveyor means, including an indexible carrier adjacent to said path, at least one pair of stack-engaging elements mounted on said carrier at an angle of 180 degrees relative to each other and movable into and from the path of movement of stacks with and relative to said conveyor means in response to indexing of said carrier, and means for indexing said carrier including a device for rotating said carrier stepwise through angles of 90 degrees.

8. The apparatus of claim 7, further comprising means for reciprocating said conveyor means between a first position in which at least a portion of said conveyor means is located outside of a receptacle at said station and is adapted to receive a stack and a second position in which said portion of said conveyor means is located in the interior of a receptacle at said station, said carrier being indexible in a predetermined direction so that one of said elements has a component of movement in the direction of movement of said conveyor means toward said second position during indexing of said carrier.

9. Apparatus for introducing stacks of paper sheets or the like into cartons or analogous receptacles at a filling station, comprising conveyor means movable along a predetermined path into and from the interior of a receptacle at said station; means for delivering stacks to said conveyor means so that a stack on said conveyor means enters the receptacle at said station when the conveyor means completes its movement into such receptacle; and means for locating stacks on said conveyor means, including an indexible carrier adjacent to said path, at least one pair of stack-engaging elements mounted on said carrier at an angle of 180 degrees relative to each other and movable into and from the path of movement of stacks with and relative to said conveyor means in response to indexing of said carrier, and means for indexing said carrier, said indexing means comprising one-way clutch means mounted on said carrier and including a rotary portion arranged to rotate said carrier in response to rotation of said portion in a predetermined direction, and means for rotating said portion of said clutch means at least in said predetermined direction.

10. The apparatus of claim 9, wherein said means for rotating said portion of said clutch means comprises a fluid-operated motor.

11. The apparatus of claim 10, wherein said motor comprises a reciprocable member articulately connected with said portion of said clutch means.

12. Apparatus for introducing stacks of paper sheets or the like into cartons or analogous receptacles at a filling station, comprising conveyor means movable along a predetermined path into and from the interior of a receptacle at said station; means for delivering stacks to said conveyor means so that a stack on said conveyor means enters the receptacle at said station when the conveyor means completes its movement into such receptacle; means for locating stacks on said conveyor means, including an indexible carrier adjacent to said path, at least one pair of stack-engaging elements mounted on said carrier at an angle of 180 degrees relative to each other and movable into and from the path of movement of stacks with and relative to said conveyor means in response to indexing of said carrier, and means for indexing said carrier, said indexing means comprising means for rotating said carrier through angles of predetermined magnitude to a plurality of different angular positions; and detent means for releasably holding said carrier in such angular positions.

13. The apparatus of claim 12, wherein said detent means comprises a female detent member affixed to said carrier and having a peripheral surface provided with recesses, one for each of said angular positions, and a male detent member having a portion movable into and from adjacent recesses of said female detent member.

14. The apparatus of claim 13, wherein said portion of said male detent member comprises a follower and said male detent member further includes a lever supporting said follower, and further comprising motor means for moving said lever between first and second positions in which said follower respectively extends into and is withdrawn from a recess of said female detent member.

15. The apparatus of claim 9, wherein said conveyor means has a stack-supporting surface and one of said elements extends into the path of movement of an oncoming stack during delivery of such stack onto said conveyor means prior to indexing of said carrier in a direction to withdraw such one element from the path of movement of the stack on said surface and before said conveyor means begins to move into the receptacle at said station, the other of said elements extending behind the stack in the receptacle at said station upon completion of introduction of the stack into the receptacle at said station so that said other element prevents the stack from leaving the receptacle during movement of said conveyor means from the receptacle at said station.

16. The apparatus of claim 1, wherein said carrier is installed at a level above said supporting surface and said elements are prongs movable to and from positions substantially at right angles to the plane of said surface.

17. The apparatus of claim 1, further comprising means for holding said carrier against indexing during intervals between the removal of a filled receptacle from and the delivery of a fresh receptacle to said station.

* * * * *